US007472694B2

(12) United States Patent
King

(10) Patent No.: US 7,472,694 B2
(45) Date of Patent: Jan. 6, 2009

(54) CARBON CANISTER WITH FILTER SYSTEM

(75) Inventor: Timothy J. King, Connersville, IN (US)

(73) Assignee: Stant Manufacturing Inc., Connersville, IN (US)

( * ) Notice: Subject to any disclaimer, the term of this patent is extended or adjusted under 35 U.S.C. 154(b) by 0 days.

(21) Appl. No.: 11/557,809

(22) Filed: Nov. 8, 2006

(65) Prior Publication Data

US 2007/0107702 A1 May 17, 2007

Related U.S. Application Data

(60) Provisional application No. 60/734,471, filed on Nov. 8, 2005.

(51) Int. Cl.
*F02M 37/04* (2006.01)

(52) U.S. Cl. ..... 123/518; 123/519; 123/520

(58) Field of Classification Search ..... 123/516, 123/518–520

See application file for complete search history.

(56) References Cited

U.S. PATENT DOCUMENTS 4,598,686 A * 7/1986 Lupoli et al. ..... 123/519
4,877,001 A * 10/1989 Kenealy et al. ..... 123/519
5,054,453 A * 10/1991 Onufer ..... 123/516
5,098,453 A 3/1992 Turner et al.
5,501,198 A * 3/1996 Koyama ..... 123/520
5,564,398 A 10/1996 Maeda et al.
5,613,477 A * 3/1997 Maeda ..... 123/519
5,632,808 A 5/1997 Hara et al.
5,638,786 A * 6/1997 Gimby ..... 123/198 E
5,641,344 A 6/1997 Takahashi et al.
5,645,036 A 7/1997 Matsumoto et al.
5,718,209 A 2/1998 Scardino et al.
5,743,943 A 4/1998 Maeda et al.
5,850,819 A * 12/1998 Kunimitsu et al. ..... 123/520
5,912,368 A * 6/1999 Satarino et al. ..... 55/320
5,957,114 A 9/1999 Johnson et al.
6,136,075 A 10/2000 Bragg et al.
6,237,574 B1 5/2001 Jamrog et al.
6,343,591 B1 * 2/2002 Hara et al. ..... 123/519
6,390,073 B1 * 5/2002 Meiller et al. ..... 123/519
6,505,641 B1 1/2003 Gebert et al.
6,553,976 B1 * 4/2003 Threadingham et al. .... 123/519
6,772,741 B1 8/2004 Pittel et al.
RE38,844 E 10/2005 Hiltzik et al.
6,959,698 B2 * 11/2005 Ikuma et al. ..... 123/519
7,008,471 B2 * 3/2006 Koyama et al. ..... 96/131
7,097,697 B2 8/2006 Nakamura et al.
7,159,579 B2 * 1/2007 Meiller et al. ..... 123/518
2005/0172938 A1 8/2005 Uchino et al.

(Continued)

OTHER PUBLICATIONS

Temperature and RVP Effects on Diumal Emissions for Nonroad Engine Modeling, Report No. NR-001, Craig Harvey, U.S. EPA Office of Mobile Sources, Assessment and Modeling Division, Nov. 12, 1997, seven pages.

*Primary Examiner*—Thomas N Moulis
(74) *Attorney, Agent, or Firm*—Barnes & Thornburg ILP

(57) ABSTRACT

A fuel vapor recovery apparatus includes a canister including a housing formed to include a first port exposed to the atmosphere and a second port exposed to fuel tank fuel vapor. A carbon bed is located in an interior region of the housing between the first and second ports.

23 Claims, 8 Drawing Sheets

U.S. PATENT DOCUMENTS

2005/0188851 A1 9/2005 Yamazaki et al.
2005/0217645 A1* 10/2005 Fukaya et al. ..... 123/519
2005/0223900 A1 10/2005 Yoshida et al.
2006/0102158 A1 5/2006 Cairns et al.
2006/0144228 A1 7/2006 Reiners et al.

* cited by examiner

CARBON CANISTER WITH FILTER SYSTEM

This application claims priority under 35 U.S.C. § 119(e) to U.S. Provisional Application Ser. No. 60/734,471, filed Nov. 8, 2005, which is expressly incorporated by reference herein.

BACKGROUND

The present disclosure relates to an engine fuel system, and particularly to a fuel vapor venting system for a fuel tank associated with an internal combustion engine. More particularly, the present disclosure relates to a carbon canister in a fuel vapor venting system.

Engine fuel systems include valves associated with a fuel tank and configured to vent pressurized or displaced fuel vapor from the vapor space in the fuel tank to a separate charcoal canister. The canister is designed to capture and store hydrocarbons entrained in fuel vapors that are displaced and generated in the fuel tank.

When an engine is running, a purge vacuum is applied to the charcoal canister via the engine intake manifold. Hydrocarbons stored (e.g., adsorbed) on charcoal held in the canister is entrained into a stream of atmospheric air drawn into the canister by the purge vacuum. This produces a stream of fuel vapor laden with "reclaimed" hydrocarbon material that is discharged from the canister through a purge hose into the intake manifold for combustion in the engine.

SUMMARY

A fuel vapor recovery apparatus comprises a housing containing an air filter and a carbon bed. The carbon bed is coupled in fluid communication to a tank vent control system associated with a fuel tank and to an engine purge valve associated with an engine. The air filter is coupled to the carbon bed and is exposed to the atmosphere outside the housing to filter atmospheric air admitted into the housing and discharge that filtered air to the carbon bed during application of a "purge" vacuum to the carbon bed via the engine purge valve.

Additional features of the present disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
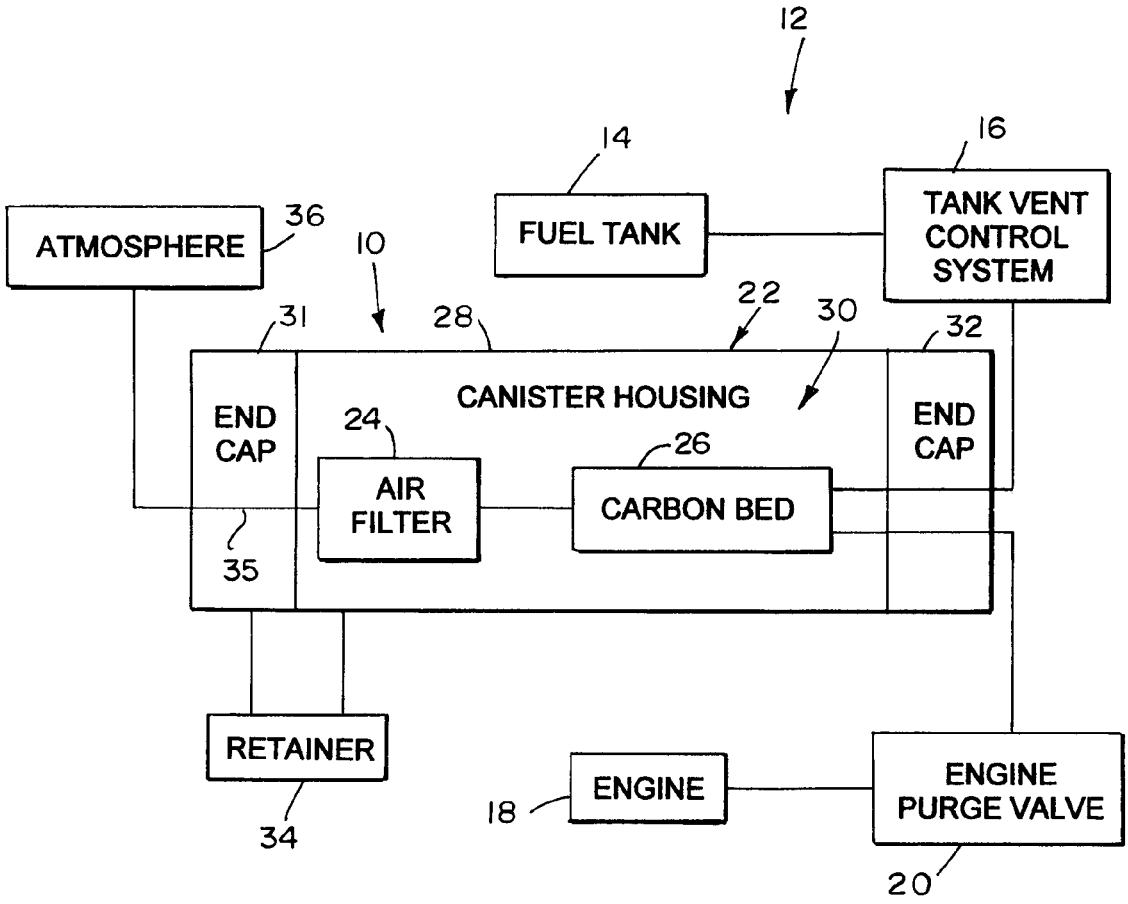
FIG. 1 is a diagrammatic view of an engine fuel system including a carbon canister in accordance with the present disclosure and showing an air filter and a carbon bed inside a housing included in the carbon canister.
Figure 2:
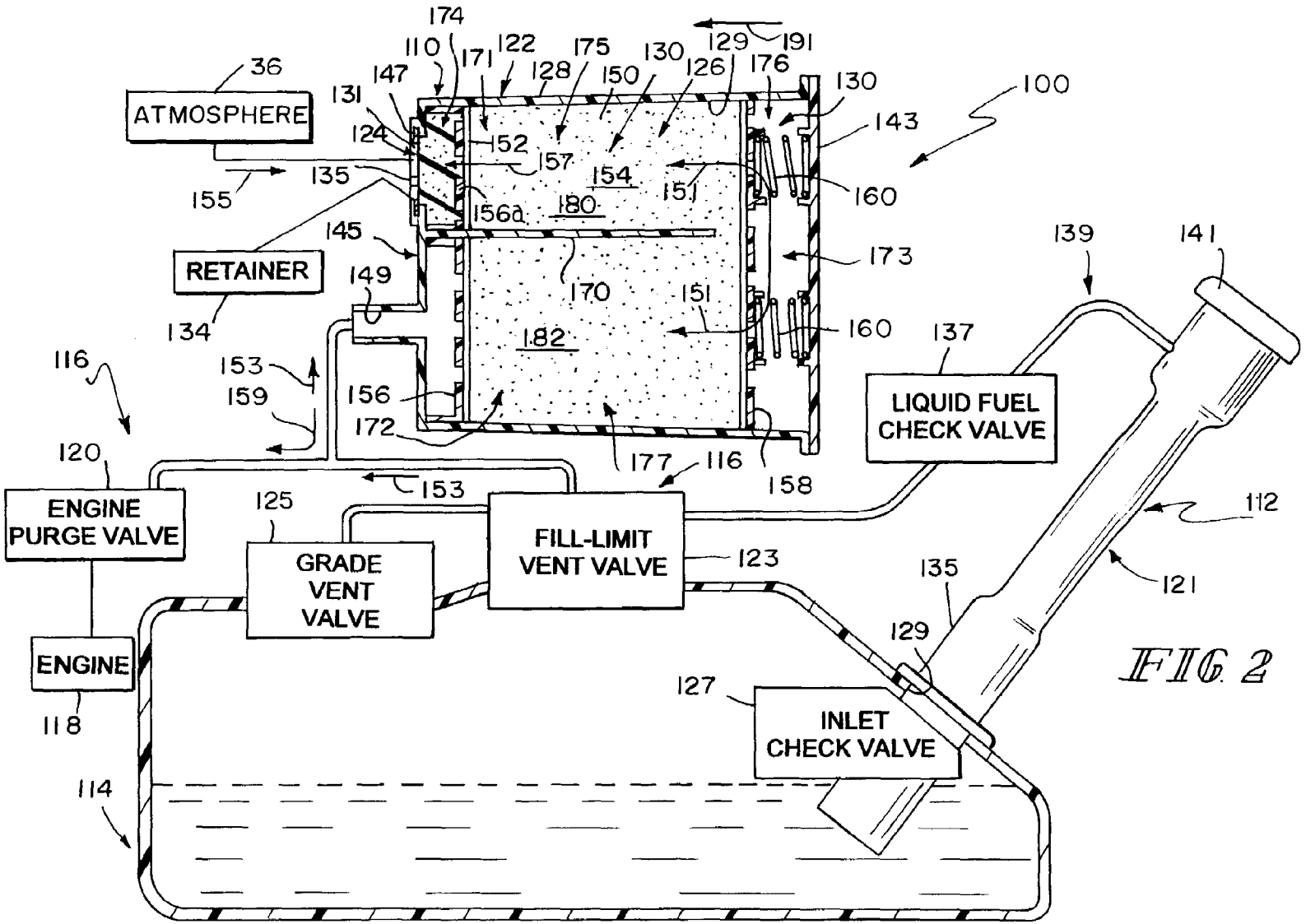
FIG. 2 is a diagrammatic view of another engine fuel system including an illustrative carbon canister in accordance with another embodiment of the present disclosure.
Figure 3:
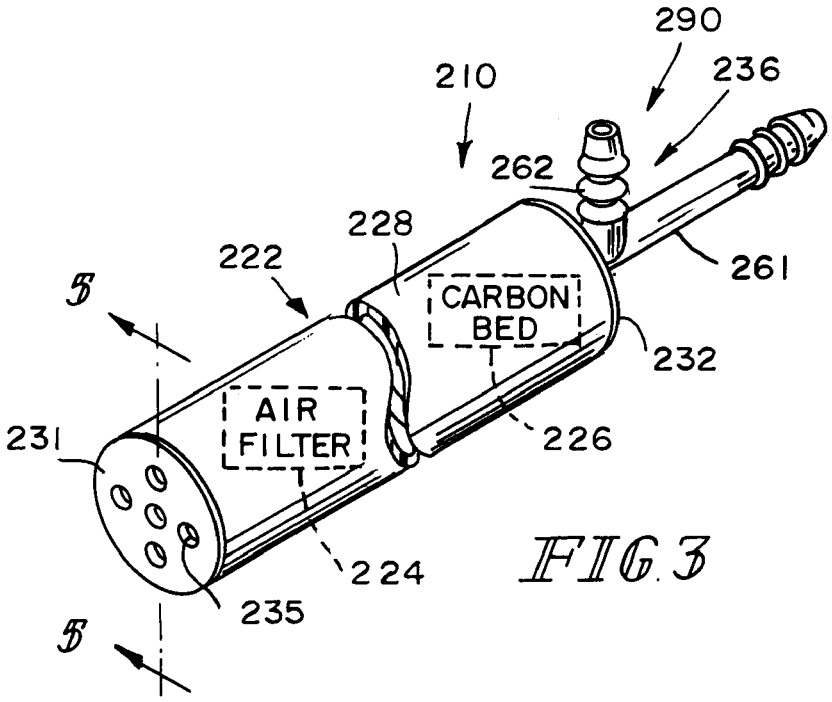
FIG. 3 is a perspective view of an illustrative embodiment of the carbon canister of FIG. 1, with portions broken away, showing (in series) a removable first end cap, a tubular side wall, a second end cap, and a T-shaped vapor conduit.
Figure 4:
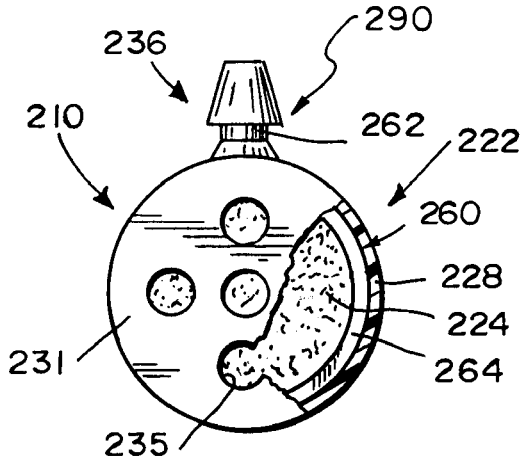
FIG. 4 is a "left-side" elevation view of the carbon canister of FIG. 3, with portions broken away, showing an air filter located adjacent to the removable first end cap in an interior region formed in the tubular side wall.

A carbon canister 10 in accordance with a first embodiment of the present disclosure is shown in FIG. 1. A carbon canister 110 in accordance with a second embodiment of the present disclosure is shown in FIG. 2. An illustrative carbon canister 210 is also shown in FIGS. 3-6 and an illustrative cam-lock end cap retainer is shown, for example in FIG. 7. Another illustrative carbon canister 310 is shown in FIGS. 8-12. In each case, the carbon canister includes a replaceable internal air filter 34, 134, 234, or 334.

As suggested diagrammatically in FIG. 1, canister 10 is included in an engine fuel system 12 comprising a fuel tank 14, tank vent control system 16, engine 18, and engine purge valve 20. Canister 10 includes a housing 22 containing an air filter 24 and a carbon bed 26. Canister 10 is configured to "clean" fuel vapor vented from fuel tank 14 through tank vent control system 16 during tank refueling. Canister 10 is "cleaned" or "purged" using a vacuum provided by engine 18 when engine 18 is running.

Canister housing 22 includes a side wall 28 formed to include an interior region 30 containing air filter 24 and carbon bed 26 arranged in series as suggested diagrammatically in FIG. 1. Canister housing 22 also includes a removable first end cap 31 coupled to one end of side wall 28 and a second end cap 32 coupled to an opposite end of side wall 28. A retainer 34 is provided to retain first end cap 31 in place on side wall 28 and is configured to be released to allow separation of first end cap 31 from side wall 28 so that a technician can remove and repair or replace air filter 24 when repair or replacement is needed. Suitable means 35 is provided in first end cap 31 for admitting air from atmosphere 36 into interior region 30 during "cleaning" or "purging" of canister 10 to cause air from atmosphere 36 to pass through air filter 24 to clean such air before it passes into and through carbon bed 26.

Air filter 24 is integrated into carbon canister 10 and mounted in interior region 30 of canister housing 22. Air filter 24 is configured to provide auxiliary means for blocking flow of dust particles extant in atmospheric air into carbon bed 26 so that the hydrocarbon filtering function of carbon canister 10 is not impeded. Such an air filter 24 is useful when carbon canister 10 is used in a "dirty" environment in connection with, for example, lawn mowers, motorcycles, snowmobiles, small off-road vehicles, and industrial gasoline-powered electricity generators. A lockable and removable end cap 31 is included in the canister housing to enable technicians to gain access to integrated air filter 24 during servicing of carbon canister 10.

An air filter 124 is placed in an interior region 130 of a canister housing 122 in series with a carbon bed 126 in another illustrative carbon canister 10 as shown, for example, in FIG. 2. Air filter 124 has a function similar to air filter 24. As suggested in FIG. 2, fuel system 112 includes fuel tank 114, tank vent control system 116, engine 118, engine purge valve 120, fuel tank filler neck 121, fill-limit vent valve 123, grade vent valve 125, and an inlet check valve 127 associated with an inlet 129 into fuel tank 114 and an outlet end 135 of filler neck 121. A liquid fuel check valve 137 is located in a fuel vapor recirculation conduit 139 coupled at one end to fill-limit vent valve 123 and at an opposite end to filler neck 121. A cap 141 is provided normally to mate with and close an open mouth 143 of filler neck 121.

As suggested in FIG. 2, canister 110 includes a housing 122 and housing 122 contains air filter 124 and carbon bed 126. Canister housing 122 includes a side wall 128 formed to include an interior region 130 and an end wall 145 appended to side wall 128 and formed to include an access aperture 147 adjacent to air filter 124. A first end cap 131 is adapted to mate with end wall 145 as shown in FIG. 2 normally to close access aperture 147. A retainer 134 is provided to retain first end cap 131 in place on end wall 145 relative to side wall 128 as suggested diagrammatically in FIG. 2.

Air filter 124 is replaceable. Retainer 134 is configured to be released to allow separation of first end cap 131 from end wall 145 so that a technician can remove or replace air filter 124 when repair or replacement is needed. Suitable means 135 (e.g., one or more apertures) is provided in first end cap 131 for admitting atmospheric air 155 into interior region 130 during cleaning and purging of canister 110 to pass through air filter 124 to clean such air before it passes into and through carbon bed 126.

Carbon bed 126 comprises carbon granules 150, left and right filter pads 152, 154, left and right filter backing plates 156, 158, and granule-compacting springs 160 as shown, for example, in FIG. 2. Granule-compacting springs 160 are arranged to urge right filter pad 154 and right filter backing plate 158 in direction 191 toward end wall 145 to compress carbon granules 150 to establish the density of carbon bed 126. Some of carbon granules 150 contact an interior surface 129 of side wall 128.

A fuel vapor recovery apparatus 100 comprises a canister 110, a carbon bed 126, and an air filter 124 as suggested, for example, in FIG. 2. Canister 110 includes a housing 122 formed to include an interior region 130, a first port 147 configured to admit atmospheric air 155 into interior region 130, and a second port 149 configured to admit fuel tank fuel vapor 153 into interior region 130. Carbon bed 126 is located in interior region 130 to intercept a stream of fuel vapor 153 exiting a fuel tank 114 and flowing into interior region 130 through second port 149 along a flow path 151 through interior region 130 from second port 149 to first port 147 and out of interior region 130 through first port 147. An air filter module comprises an air filter 124 located in interior region 130. Air filter 124 is positioned to lie in flow path 151 to intercept the stream of fuel vapor 157 exiting carbon bed 126 and flowing out of interior region 130 through first port 147 and to intercept atmospheric air 155 flowing into interior region 130 through first port 147 and along flow path 151 toward carbon bed 126 and second port 149.

A flow controller 116 provides means for discharging fuel vapor 153 exhausted from a fuel tank 114 into interior region 130 of housing 122 through second port 149 to flow along flow path 151 through interior region 130 first through carbon bed 126 and then in sequence through air filter 124 and out of interior region 130 through first port 147. Flow controller 116 also provides means for applying a vacuum 159 generated by an engine intake 120 when an engine 118 coupled to engine intake 120 is running to interior region 130 through second port 149 to cause atmospheric air 155 to be drawn into interior region 130 through first port 147 to flow along flow path 151 first through air filter 124 and then in sequence through carbon bed 126 and out of interior region 130 through second port 149.

Housing 122 is formed to include means 134 for retaining air filter 124 temporarily in interior region 130 so that air filter 124 can be removed from interior region 130 for regeneration or replacement. In an illustrative embodiment, canister 110 includes a removable end cap 131 arranged to mate with housing 122 to close first port 147. Canister 110 is formed to include vent aperture means (e.g., aperture 135) for admitting atmospheric air 155 into interior region 130 to reach air filter 124 and a retainer 134 coupled to removable end cap 131 and to housing 122 to retain removable end cap 124 temporarily in a mounted position on housing 122 and to retain air filter 124 in interior region 130 of housing 122 in a position exposed to atmospheric air 155 admitted into interior region 130 through vent aperture means 135 formed in removable end cap 131 until separation of removable end cap 131 from housing 132 is needed to gain access to air filter 124 to allow a user to regenerate or replace air filter 124.

As suggested in FIG. 2, housing 122 includes a side wall 128 formed to include interior region 130 and a first end wall 145 coupled to side wall 128 and formed to include first port 147 and second port 149. Housing 122 further includes a second end wall 43 coupled to side wall 128 to lie in spaced-apart relation to first end wall 145 to define interior region 130 therebetween. Housing 122 also includes a partition wall 170 coupled to first end wall 145 and arranged to partition interior region 130 into a first chamber 171 in communication with first port 147, a second chamber 172 in communication with second port 149, and a turnaround chamber 173 arranged to interconnect and lie in fluid communication with first and second chambers 171, 172 to provide flow path 151 with the following sections extending, in sequence, from first port 147 to second port 149, a filter section 174 communicating with first port 147 and containing air filter 124, a first bed section 175 containing a first portion 181 of carbon bed 126, a turnaround section 176 defining turnaround chamber 173, and a second bed section 177 containing a second portion 182 of carbon bed 126 and communicating with second port 149.

Canister 110 further includes a movable compactor plate 158 defining a boundary between turnaround chamber 173 and each of first and second chambers 171, 172. Canister 110 also includes spring means 160 located in turnaround chamber 173 for yieldably urging compactor plate 158 in a direction 191 toward first end wall 145 to compress carbon granules 150 extant in each of first and second portions 181, 182 of carbon bed 126 to establish the density of each of first and second portions 181, 182 of carbon bed 126. Canister 110 further includes a fixed compactor plate 156*a* located in a fixed position in first chamber 171 to define a boundary separating filter section 174 and first bed section 175. Carbon granules 150 extant in first portion 181 of carbon bed 126 lie between fixed and movable compactor plates 156*a*, 158 as shown, for example, in FIG. 2.

An air filter 224 is mounted in series with a carbon bed 226 in yet another illustrative canister 210 as suggested, for example, in FIGS. 3-6. Canister 210 is sized, shaped, and well-suited for use in a power source associated with a small internal combustion engine. Canister 210 is included in a power source 200 comprising an internal combustion engine 218 and a fuel tank 214 as shown diagrammatically in FIGS. 5 and 6.

A fuel vapor recovery apparatus 201 includes canister 210, air filter 224, and carbon bed 226. Air filter 224 has a function similar to air filters 24 and 124.

Figure 5:
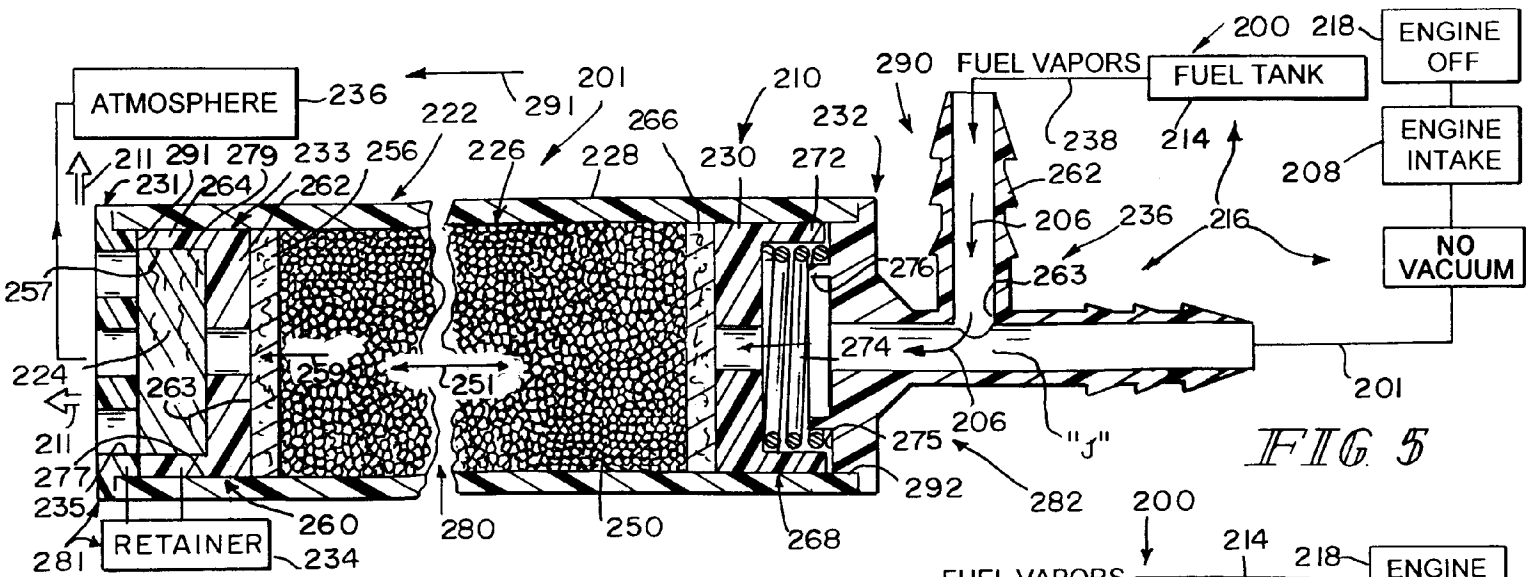
FIG. 5 is an enlarged sectional view taken along line 5-5 of FIG. 3 showing a canister housing comprising the tubular side wall and the two end caps and containing an air filter and a carbon bed and showing flow of vented fuel vapor from the fuel tank through the T-shaped vapor conduit to cause hydrocarbons associated with the vented fuel vapor to be captured by the carbon bed and showing cleaned vapor discharged from the carbon canister to the atmosphere.
Figure 6:
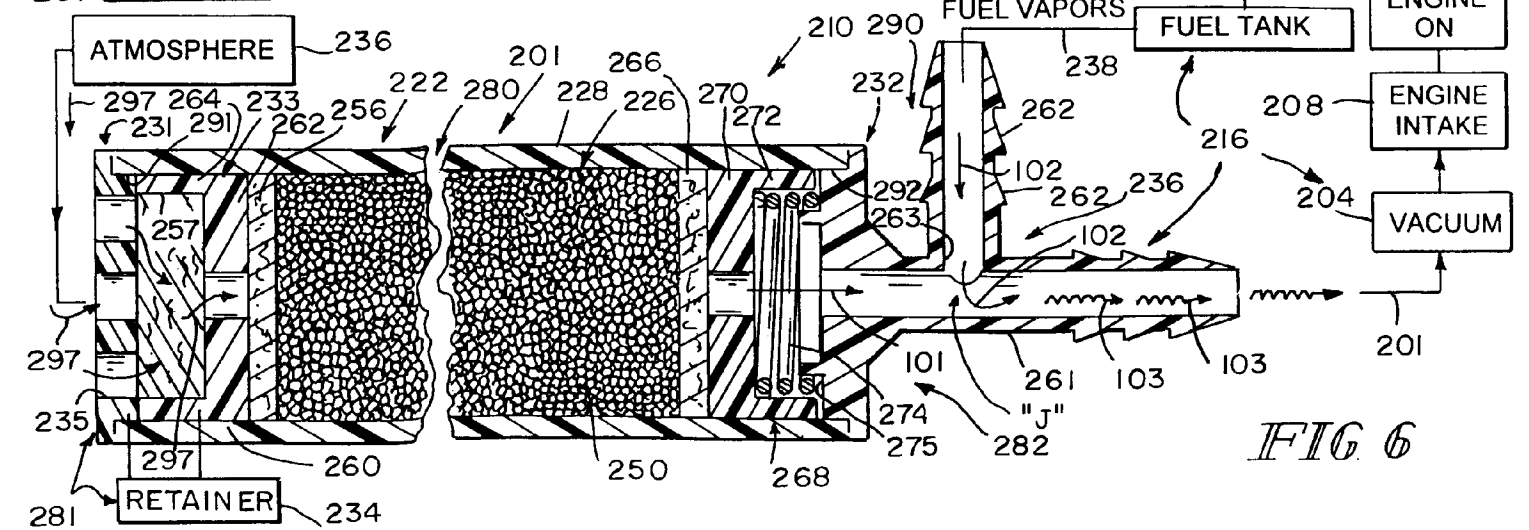
FIG. 6 is a sectional view similar to FIG. 5 showing "purging" of the carbon bed in the canister housing by means of a purge vacuum applied through the T-shaped vapor conduit and showing filtration of air drawn by the purge vacuum from the atmosphere in the air filter and movement of the filtered air through the carbon bed toward the T-shaped vapor conduit.
Figure 7:
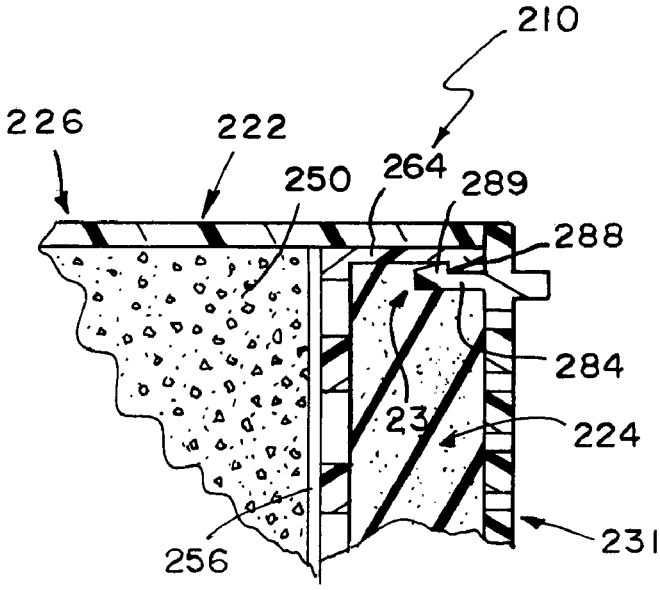
FIG. 7 is a partial sectional view of a carbon canister similar to the canister shown in FIGS. 3-6 showing an illustrative "cam-lock" end cap retainer.
Figure 8:
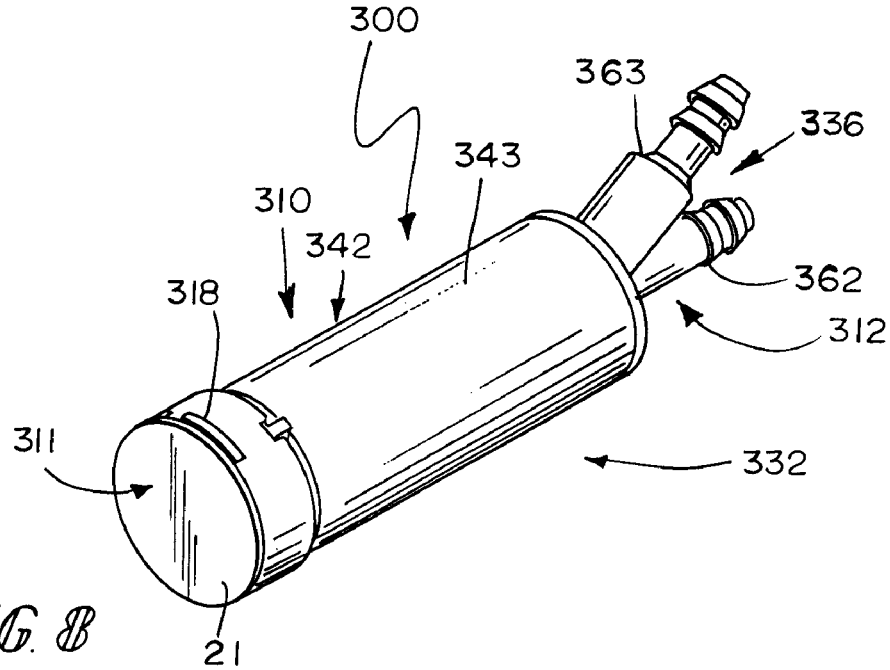
FIG. 8 is a perspective view of another illustrative embodiment of a fuel vapor recovery apparatus.
Figure 9:
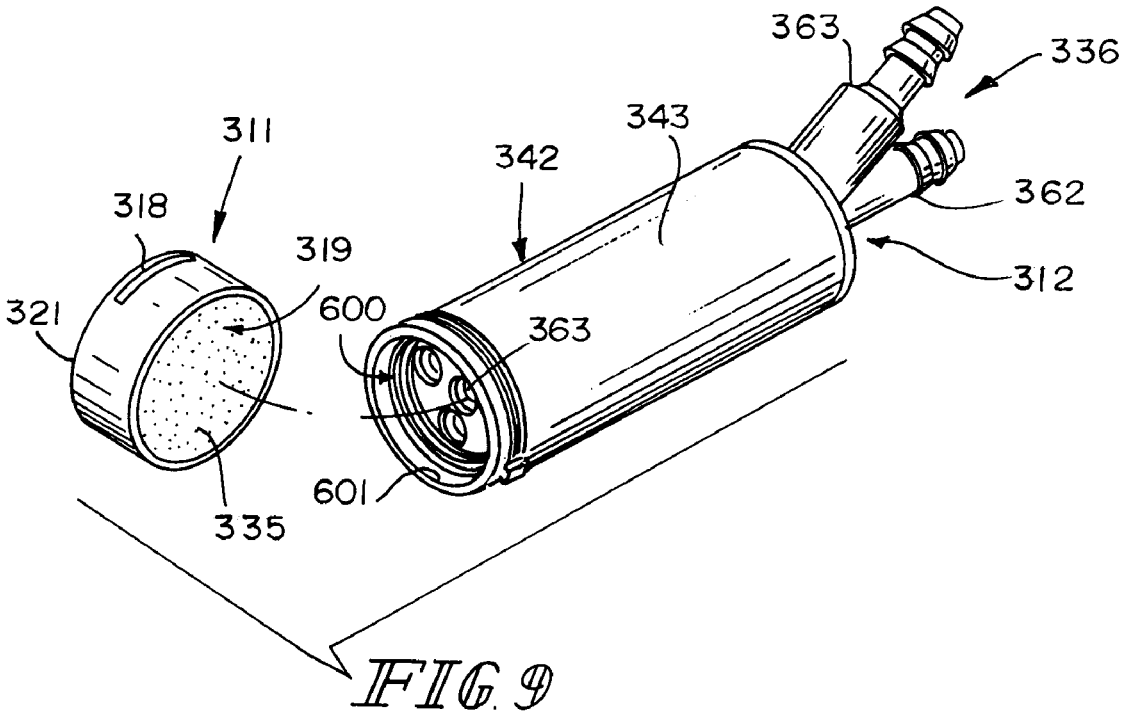
FIG. 9 is a view similar to FIG. 8 showing removal of a filter unit comprising a filter cap and a fresh-air foam filter retained in an interior region of the filter cap from a housing.
Figure 11:
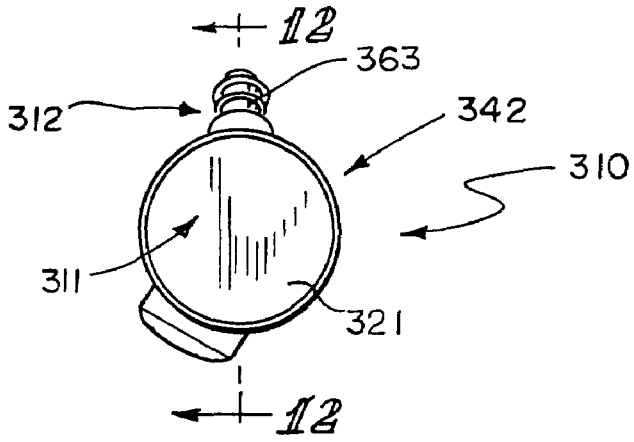
FIG. 11 is a left-end elevation of the fuel vapor recovery apparatus of FIG. 9.

Canister 210 has a housing 222 containing air filter 224 and carbon bed 226 as suggested in FIGS. 5 and 6. Housing 222 includes a side wall or cylindrical sleeve 228 interposed between first and second end caps 231, 232 as suggested in FIGS. 3 and 5. It is within the scope of this disclosure to provide sleeve 228 with any suitable length and shape and form end caps 231, 232 to mate with sleeve 228.

A retainer 234 is provided to retain first end cap 231 in place on cylindrical sleeve 228 as suggested diagrammatically in FIGS. 5 and 6. In an illustrative embodiment shown in FIG. 7, retainer 234 is a "cam-lock" retainer defined by a radially inwardly extending annular lip 288 appended to a plate support 264 and a mating radially outwardly extending rim 289 appended to a flange 284 included in first end cap 231. Plate support 264 is cylinder-shaped in the illustrated embodiment. This "snap-together" joint functions to retain first end cap 231 on sleeve 228 and can be "released" to allow separation of first end cap 231 from sleeve 228 to allow a technician to gain access to auxiliary air filter 224 to expedite regeneration or replacement of air filler 224.

Canister 210 is configured to "clean" fuel vapor 206 vented from fuel tank 214 during, for example, tank refueling as suggested diagrammatically in FIG. 5 and is "cleaned" or "purged" using a vacuum 204 provided by engine intake 208 (e.g., a carburetor) when engine 214 is running as suggested diagrammatically in FIG. 6. In use, hydrocarbon material (not shown) entrained in fuel vapor 206 discharged from fuel tank 214 and passed through carbon bed 226 is captured or stored (e.g., adsorbed) on charcoal granules 250 included in carbon bed 226 as that fuel vapor 206 passes through carbon bed 226. A stream of cleaned vapor 211 is discharged from canister 210 to the atmosphere 236 during a fuel vapor-cleaning process as suggested diagrammatically in FIG. 5.

First end cap 231 of canister 210 is formed to include apertures 235 arranged to communicate with atmosphere 236 as suggested in FIGS. 3-6. First end cap 231 is included in a first end closure 281 coupled to housing 222 to close a first port or atmospheric orifice 291 formed in housing 222 and arranged to open into interior region 280 of housing 222 as shown, for example, in FIGS. 5 and 6.

Interposed in series between carbon bed 226 and first end cap 231 is an air filter module 233 comprising a porous first filter pad 256, a first filter pad locator 260 comprising a filter backing plate 262 and a cylinder-shaped plate support 264, and auxiliary air filter 224, as shown, for example, in FIG. 5. In an illustrative embodiment, air filter 224 is removable from a pocket 257 formed in first filter pad locator 260 for regeneration (e.g., cleaning) or replacement following removal of first end cap 231 from a mounted position on housing 222. Filter backing plate 262 is cross-shaped and is formed to include a central aperture 263 and four surrounding apertures (not shown) in an illustrative embodiment as suggested in FIG. 5.

Interposed in series between carbon bed 226 and second end cap 232 is a porous second filter pad 266, a second filter pad locator 268 comprising a second filter backing plate 270 and a cylindrical ring-shaped plate support 272, and a locator-biasing spring 274 surrounded, at least in part, by ring-shaped plate support 272 as suggested in FIG. 5. In an illustrative embodiment, second filter backing plate 270 has a shape similar to that of first filter backing plate 262.

Locator-biasing spring 274 is used to move second filter locator 268 inside housing 222 toward first filter pad locator 260 to compact carbon granules 250 included in carbon bed 226 to govern the density of carbon granules in carbon bed 226. In the illustrated embodiment, an inner portion of locator-biasing spring 274 engages second filter backing plate 270 of second filter pad locator 268 and an outer portion of locator-biasing spring 274 engages an interior wall 275 of second end cap 232 and mates with a spring retainer 276 on that interior wall 275 as suggested in FIGS. 5 and 6. In the illustrated embodiment, locator-biasing spring 274 is a helical compression spring.

A T-shaped vapor conduit 236 is coupled to canister 210 and includes a first tube 261 arranged to interconnect canister 210 and a conduit 201 coupled to engine intake 208 and a second tube 262 appended to first tube 261 at an aperture 263 formed in first tube 261 as suggested in FIGS. 5 and 6. One end of first tube 261 is coupled to second end cap 231 and an opposite end of first tube 261 is coupled to conduit 201. In an illustrative embodiment, a monolithic component 290 made of a plastics material is formed to include T-shaped vapor conduit 236 and second end cap 232, as shown, for example, in FIGS. 5 and 6.

During a tank-venting situation shown diagrammatically in FIG. 5, vented fuel vapor 206 is discharged from fuel tank 214 and flows through vapor line 238 and tubes 262 and 261 of "three-way" vapor conduit 236 into carbon bed 226 in canister 210. Hydrocarbons (not shown) associated with vented fuel vapor 206 are captured by carbon bed 226 and cleaned vapor 211 is passed through auxiliary air filter 224 and discharged from canister 210 through apertures 235 formed in first end cap 231 to atmosphere 236.

Later on, when engine 218 is running, a purge vacuum 204 (generated using any suitable means) is applied to first tube 261 via vapor purge line or conduit 201 to purge hydrocarbon material (not shown) from carbon bed 226 in canister 210. Purge vacuum 204 is thus exposed to vapor in canister 210 and three-way vapor conduit 236. This causes atmospheric air 297 to be drawn into and through auxiliary air filter 224 and then carbon bed 226 to produce a first stream 101 of fuel vapor (laden with hydrocarbons released from carbon bed 226) that mixes with a second stream 102 of fuel vapor discharged from fuel tank 214 into three-way vapor conduit 236 to produce a fuel vapor mixture 103 that passes through vapor purge line 201 and flows to engine 214 for combustion therein.

Internal combustion engines of the type used in lawn mowers, motorcycles, snowmobiles, small off-road vehicles, boats, and gasoline-powered electricity generators operate in dirty and dusty environments. Inclusion of a serviceable auxiliary air filter alongside a carbon bed in a carbon canister enhances the vapor-cleaning function of the carbon bed in an economical and compact package. The air filter can be cleaned at specified intervals.

In illustrative embodiments, the housing end caps are made of an engineering resin. The end cap that is removable to provide access to the serviceable auxiliary air filter could be a snap-fit, cam-lock device that retains the filter in a mounted position in the housing.

A fuel vapor recovery apparatus 200 comprises a canister 210, a carbon bed 226, and an air filter 224 as suggested, for example, in FIGS. 3-6. Canister 210 includes a housing 222 formed to include an interior region 280, a first port 291 configured to admit atmospheric air 297 into interior region 280, and a second port 292 configured to admit fuel tank fuel vapor 206 into interior region 280. Carbon bed 226 is located in interior region 280 to intercept a stream of fuel vapor 206 exiting a fuel tank 214 and flowing into interior region 280 through second port 192 along a flow path 251 through interior region 280 from second port 292 to first port 291 and out of interior region 280 through first port 291.

Air filter module 233 comprises an air filter 224 located in interior region 280. Air filter module 233 is positioned to lie in flow path 251 to intercept the stream of fuel vapor 259 exiting carbon bed 226 and flowing out of interior region 280 through first port 291 and to intercept atmospheric air 297 flowing into interior region 280 through first port 291 and along flow path 251 toward carbon bed 226 and second port 292.

A flow controller 216 provides means 236 for discharging fuel vapor 206 exhausted from a fuel tank 214 into interior region 280 of housing 222 through second port 292 to flow along flow path 251 through interior region 280 first through carbon bed 226 and then in sequence through air filter 224 and out of interior region 280 through first port 291. Flow controller 216 also provides means 208, 236 for applying a vacuum generated by an engine intake 208 when an engine 218 coupled to engine intake 208 is running to interior region 290 through second port 292 to cause atmospheric air 297 to be drawn into interior region 280 through first port 291 to flow along flow path 251 first through air filter 224 and then in sequence through carbon bed 226 and out of interior region 280 through second port 292.

Housing 222 is formed to include means 234 for retaining air filter 224 temporarily in interior region 280 so that air filter 224 can be removed from interior region 280 for regeneration or replacement. In an illustrative embodiment, canister 210 includes a removable end cap 231 arranged to mate with housing 222 to close first port 291. Canister 210 is formed to include vent aperture means 235 for admitting atmospheric air 297 into interior region 280 to reach air filter 224 and a retainer 234 coupled to removable end cap 231 and to housing 222 to retain removable end cap 231 temporarily in a mounted position on housing 222 and air filter 224 in interior region 280 of housing 222 in a position exposed to atmospheric air 297 admitted into interior region 280 through vent aperture means 235 formed in removable end cap 231 until separation of removable end cap 231 from housing 222 is needed to gain access to air filter 224 to allow a user to regenerate or replace air filter 224.

Canister 210 includes a first end closure 281 coupled to housing 222 to close first port 291 and a second end closure 282 coupled to housing 222 to close second port 292. Air filter 224 is located between first end closure 281 and carbon bed 226. Carbon bed 226 is located between air filter 224 and second end closure 282.

Air filter module 233 further includes a porous first filter pad 256 mating with carbon bed 226 and a filter backing plate 262 interposed between air filter 224 and porous first filter pad 256. Filter backing plate 262 is formed to include an aperture 263 arranged to conduct the stream of fuel vapor 259 flowing along flow path 251 from porous first filter pad 256 to air filter 224 and to conduct atmospheric air 297 flowing along flow path 251 from air filter 224 to porous first filter pad 256. Air filter module 233 further includes a plate support 264 coupled to filter backing plate 262 and arranged to extend from filter backing plate 262 in a direction 291 away from carbon bed 226 to form a pocket 257 having an outer opening and receiving air filter 224 therein. Plate support 264 is ring-shaped and arranged to surround a perimeter edge 279 of air filter 224 and lie in an annular space 277 provided between air filter 224 and housing 222 as suggested in FIG. 5. Plate support 264 and filter backing plate 262 cooperate to form a monolithic first filter pad locator 260 made of a plastics material.

First end closure 281 includes a first end cap 231 arranged to mate with housing 222 and formed to include an aperture opening 235 into interior region 280 of housing 222 and retainer means 234 for releasably retaining first end cap 231 in place on housing 222 to retain air filter 224 in pocket 257 and to allow separation of first end cap 231 from housing 222 to allow a technician to gain access to air filter 224. As suggested in FIG. 7, retainer means 234 is a cam-lock retainer defined by a radially inwardly extending annular lip 288 appended to plate support 264 and a mating radially outwardly extending rim 289 appended to a flange 284 included in first end cap 231 in a "snap-together" relation.

Housing 222 includes a side wall 228 formed to include interior region 280 and first port 291 opens into interior region 280. Canister 210 further includes a removable first end cap 231 arranged to close first port 291 and formed to include vent aperture means 235 for admitting atmospheric air 297 into interior region 280 to reach air filter 224 and a retainer 234 coupled to removable first end cap 231 and to housing 222 to retain removable first end cap 231 temporarily in a mounted position on housing 222 and air filter 224 in interior region 280 of housing 222 in a position exposed to atmospheric air 297 admitted into interior region 280 through vent aperture means 235 formed in removable first end cap 231 until separation of first end cap 231 from housing 222 is needed to gain access to air filter 224 to allow a user to regenerate or replace air filter 224.

As suggested in FIGS. 8-12, an alternative fuel vapor recovery apparatus 300 comprises a canister 310 including a housing 342. Housing 342 is formed to include an interior region 600 containing a carbon bed 344. Housing 342 is also formed to include an atmosphere orifice 601 opening into interior region 600, and a tank-and-engine orifice 602 opening into interior region 600 as suggested in FIG. 12.

Figure 12:
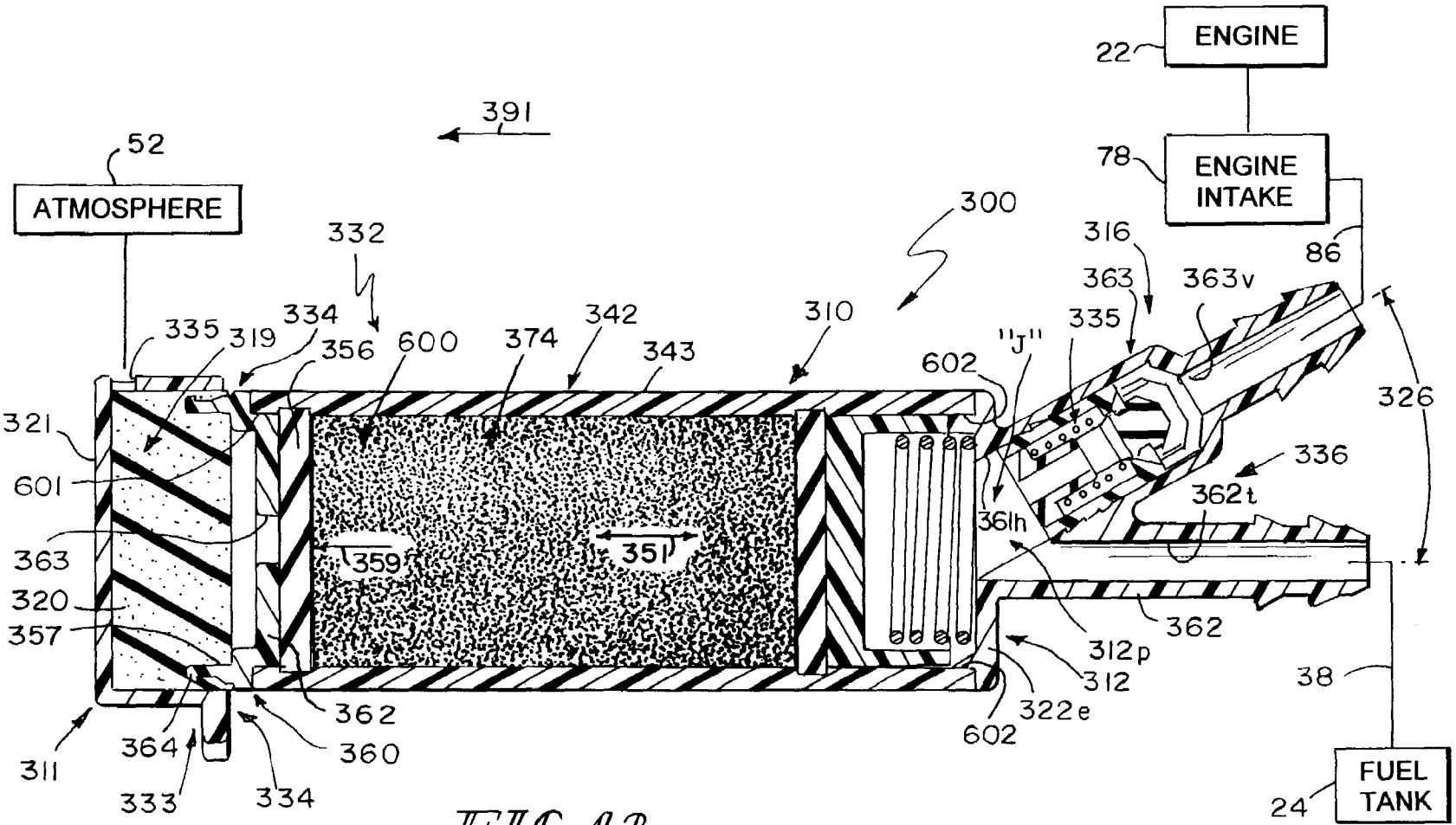
FIG. 12 is an enlarged sectional view taken along line 12-12 of FIG. 11 showing a carbon canister housing containing a carbon bed, a filter unit coupled to a left end of the housing, and a "two-way" vapor conductor coupled to the right end of the housing and formed to include a vapor tube adapted to be coupled to a fuel tank and a vacuum tube adapted to be coupled to an engine intake associated with an engine and configured to contain a vacuum-actuated check valve.

In an illustrative embodiment, housing 342 includes a cylindrical sleeve 343 interposed between first and second end closures 311, 312 as suggested in FIG. 12. It is within the scope of this disclosure to provide sleeve 343 with any suitable length and shape and form end closures 311, 312 to mate with sleeve 343. One end of sleeve 343 is formed to include atmospheric orifice 601 and another end of sleeve 343 is formed to include tank-and-engine orifice 602. Housing 343 and first and second end closures 311, 312 cooperate to define a canister 332.

First end closure 311 comprises a filter cap 321 formed to include an interior region 319 containing an air filter 324 made, for example, of a porous foam material as suggested in FIG. 12. Filter cap 321 is formed to include a port 319 in communication with the atmosphere 352. Air filter 324 has a function similar to air filters 24, 124, and 224.

Figure 10:
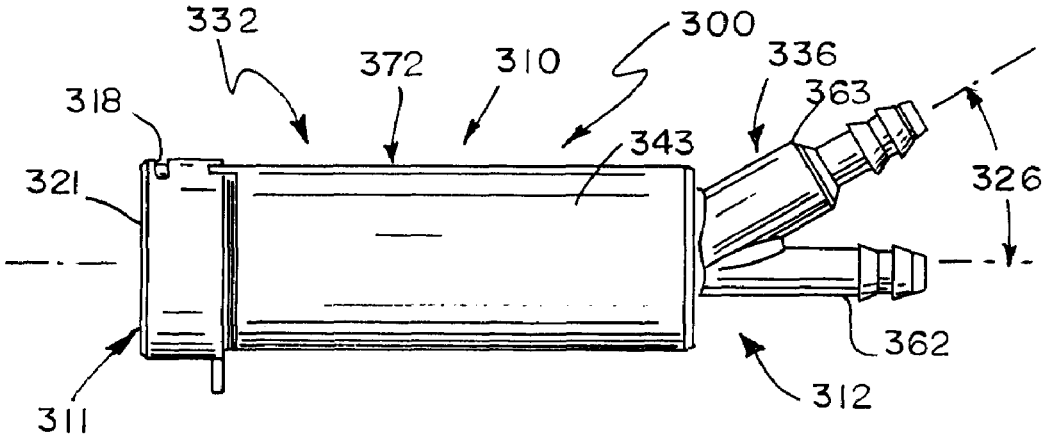
FIG. 10 is a side elevation of the fuel vapor recovery apparatus of FIG. 9.

Second end closure 312 comprises a second end cap 322 and a two-way vapor conduit 326 coupled to second end cap 322 as suggested in FIGS. 10 and 12. In the illustrated embodiment, two-way conduit 336 includes a lower tube section 362 formed to include a tank channel 362*t* and an upper tube section 363 formed to include a vacuum channel 363*v* as suggested in FIG. 12. A housing channel (or aperture) 361*h* is formed in an end plate 322*e* of second end cap 322. Housing channel or aperture 361*h*, tank channel 362*t*, and vacuum channel 363*v* merge with one another in fluid communication at a junction "J" located inside second end closure 312 as shown, for example, in FIG. 12. A housing channel (or aperture) 361*h* is formed in an end plate 322*e* of second end cap 322. Housing channel or aperture 361*h* is formed in an end plate 322*e* of second end cap 322. Housing channel or aperture 361*h*, tank channel 362*t*, and vacuum channel 363*v* merge with one another in fluid communication at a junction "J" located inside second end closure 312 as shown, for example, in FIG. 12.

As suggested in FIG. 12, second end closure 312 is coupled to housing 342 to close tank-and-engine orifice 602. Second end closure 312 is formed to include a passageway 312*p* arranged to provide vapor/vacuum means for conducting inbound fuel vapor from fuel tank 24 into interior region 600 of housing 342 and outbound fuel vapor from interior region 600 of housing 342 to an engine intake 48 coupled to an engine 22 associated with fuel tank 24 as suggested in FIG. 12. In the illustrated embodiment shown in FIG. 12, housing channel or aperture 362*t* defines a "second portion" thereof, and vacuum channel 363*v* defines a "third portion" thereof.

In an illustrative embodiment shown, for example, in FIG. 12, lower tube section 363 of two-way vapor conduit 336 terminates at a tank house mount adapted to mate with a tank hose or vapor line 38 configured to conduct fuel vapor between fuel tank 24 and tank channel 362*t*. As also shown in FIG. 12, upper tube section 363 of two-way vapor conduit 336 terminates at a vacuum hose mount adapted to mate with a vacuum hose or purge line 86 configures to conduct vacuum between vacuum channel 363*v* and engine intake 48.

In an illustrative embodiment shown in FIG. 12, lower and upper tube sections 362, 363 cooperate to define an acute included angle 326 therebetween. Included angle 326 is, for example, about 26°. It is within the scope of this disclosure to provide a suitable normally closed vacuum-actuated channel-opening valve means 335 in vacuum channel 363*v* as suggested in FIG. 12.

The components (including carbon bed 344) provided inside sleeve 343 of housing 342 are similar to those internal components shown in FIGS. 5 and 6. Moreover, fuel vapor recovery apparatus 300 operates, for example, in a manner similar to fuel vapor recovery apparatus 10 shown, for example, in FIGS. 5 and 6.

A flow controller 316 provides means for discharging fuel vapor exhausted from a fuel tank 24 into interior region 600 of housing 342 through second port 602 to flow along a flow path 351 through interior region 600 first through carbon bed 326 and then in sequence through air filter 324 and out of interior region 600 through first port 601. Flow controller 316 also provides means for applying a vacuum generated by an engine intake 48 when an engine 22 coupled to engine intake 48 is running to interior region 600 through second port 602 to cause atmospheric air to be drawn into interior region 600 through first port 601 to flow along flow path 351 first through air filter 324 and then in sequence through carbon bed 326 and out of interior region 600 through second port 602.

Housing 342 is formed to include means 334 for retaining air filter 324 temporarily in or in communication with interior region 600 so that air filter 324 can be removed from interior region 600 for regeneration or replacement. In an illustrative embodiment, canister 310 includes a removable end cap 321 arranged to mate with housing 342 to close first port 601. Canister 310 is formed to include vent aperture means 335 for admitting atmospheric air into interior region 600 to reach air filter 324 and a retainer 334 coupled to removable end cap 321 and to housing 342 to retain removable end cap 321 temporarily in a mounted position on housing 342 and air filter 324 in or in communication with interior region 600 of housing 342 in a position exposed to atmospheric air admitted into interior region 600 through vent aperture means 335 formed in removable end cap 321 until separation of removable end cap 321 from housing 342 is needed to gain access to air filter 324 to allow a user to regenerate or replace air filter 324.

Canister 310 includes a first end closure 311 coupled to housing 342 to close first port 601 and a second end closure 312 coupled to housing 342 to close second port 602. Air filter 324 is located between first end closure 311 and carbon bed 344. Carbon bed 344 is located between air filter 324 and second end closure 312.

Air filter module 333 includes air filter 324, a porous first filter pad 356 mating with carbon bed 344, and a filter backing plate 362 interposed between air filter 324 and porous first filter pad 356. Filter backing plate 362 is formed to include an aperture 353 arranged to conduct the stream of fuel vapor 359 flowing along flow path 351 from porous first filter pad 356 to air filter 324 and to conduct the atmospheric air flowing along flow path 351 from air filter 324 to porous first filter pad 356. Air filter module 333 further includes a plate support 364 coupled to filter backing plate 362 and arranged to extend from filter backing plate 362 in a direction 391 away from carbon bed 344 to form a pocket 357 having an outer opening and receiving a portion of air filter 324 therein. Plate support 362 is ring-shaped and arranged to surround a portion of air filter 324. Plate support 364 and filter backing plate 362 cooperate to form a monolithic first filter pad locator 360 made of a plastics material.

First end closure 311 includes a first end cap 360 arranged to mate with housing 342 and formed to include an aperture opening 335 into interior region 600 of housing 342 and retainer means 334 for releasably retaining first end cap 321 in place on housing 342 to retain a portion of air filter 342 in pocket 357 and to allow separation of first end cap 321 from housing 342 to allow a technician to gain access to air filter 342. As suggested in FIG. 12, the retainer means 334 is a cam-lock retainer defined by a radially outwardly extending annular lip appended to plate support 364 and a mating radially inwardly extending rim appended to a flange included in first end cap 321 in a "snap-together" relation.

Housing 344 includes a side wall 343 formed to include interior region 600 and first port 601 opens into interior region 600. Canister 343 further includes a removable first end cap 321 arranged to close first port 601 and formed to include vent aperture means 335 for admitting atmospheric air into interior region 600 to reach air filter 324 and a retainer 334 coupled to removable first end cap 321 and to housing 342 to regain removable first end cap 321 temporarily in a mounted position on housing 342 and air filter 324 in or in communication with interior region 600 of housing 342 in a position exposed to atmospheric air admitted into interior region 600 through vent aperture means 335 formed in removable first end cap 321 until separation of first end cap 321 from housing 342 is needed to gain access to air filter 324 to allow a user to regenerate or replace air filter 324.

The invention claimed is:

1. A fuel vapor recovery apparatus comprising a canister including a housing formed to include an interior region, a first port configured to admit atmospheric air into the interior region, and a second port configured to admit fuel tank fuel vapor from outside the canister into the interior region, a carbon bed located in the interior region to intercept a stream of fuel vapor exiting a fuel tank and flowing into the interior region through the second port along a flow path through the interior region from the second port to the first port and out of the interior region through the first port, and an air filter module comprising an air filter located in the interior region and positioned to lie in the flow path to intercept the stream of fuel vapor exiting the carbon bed and flowing out of the interior region through the first port and to intercept atmospheric air flowing into the interior region through the first port, along the flow path through the carbon bed and through the second port.

2. The apparatus of claim 1, further comprising flow control means for discharging fuel vapor exhausted from a fuel tank into the interior region of the housing through the second port to flow along the flow path through the interior region first through the carbon bed and then in sequence through the air filter and out of the interior region through the first port and for applying a vacuum generated by an engine intake when an engine coupled to the engine intake is running to the interior region through the second port to cause atmospheric air to be drawn into the interior region through the first port to flow along the flow path first through the air filter and then in sequence through the carbon bed and out of the interior region through the second port.

3. The apparatus of claim 1, wherein the housing is formed to include means for retaining the air filter temporarily in the interior region so that the air filter can be removed from the interior region for regeneration or replacement.

4. The apparatus of claim 1, wherein the canister further includes a removable end cap arranged to mate with the housing to close the first port and formed to include vent aperture means for admitting atmospheric air into the interior region to reach the air filter, and a retainer coupled to the removable end cap and to the housing to retain the removable end cap temporarily in a mounted position on the housing and the air filter in the interior region of the housing in a position exposed to atmospheric air admitted into the interior region through the vent aperture means formed in the removable end cap until separation of the removable end cap from the housing is needed to gain access to the air filter to allow a user to regenerate or replace the air filter.

5. The apparatus of claim 1, wherein the housing includes a side wall formed to include the interior region and a first end wall coupled to the side wall and formed to include the first port and the second port.

6. A fuel vapor recovery apparatus comprising a canister including a housing formed to include an interior region, a first port configured to admit atmospheric air into the interior region, and a second port configured to admit fuel tank fuel vapor into the interior region, a carbon bed located in the interior region to intercept a stream of fuel vapor exiting a fuel tank and flowing into the interior region through the second port along a flow path through the interior region from the second port to the first port and out of the interior region through the first port, and an air filter module comprising an air filter located in the interior region and positioned to lie in the flow path to intercept the stream of fuel vapor exiting the carbon bed and flowing out of the interior region through the first port and to intercept atmospheric air flowing into the interior region through the first port and along the flow path toward the carbon bed and the second port, wherein the housing includes a side wall formed to include the interior region and a first end wall coupled to the side wall and formed to include the first port and the second port and wherein the housing further includes a second end wall coupled to the side wall to lie in spaced-apart relation to the first end wall to define the interior region therebetween and a partition wall coupled to the first end wall and arranged to partition the interior region into a first chamber in communication with the first port, a second chamber in communication with the second port, and a turnaround chamber arranged to interconnect and lie in fluid communication with the first and second chambers to provide the flow path with the following sections extending, in sequence, from the first port to the second port, a filter section communicating with the first port and containing the air filter, a first bed section containing a first portion of the carbon bed, a turnaround section defining the turnaround chamber, and a second bed section containing a second portion of the carbon bed and communicating with the second port.

7. The apparatus of claim 6, wherein the canister further includes a movable compactor plate defining a boundary between the turnaround chamber and each of the first and second chambers and spring means located in the turnaround chamber for yieldably urging the compactor plate in a direction toward the first end wall to compress carbon granules extant in each of the first and second portions of the carbon bed to establish the density of each of the first and second portions of the carbon bed.

8. The apparatus of claim 7, wherein the canister further includes a fixed compactor plate located in a fixed position in the first chamber to define a boundary separating the filter section and the first bed section and wherein carbon granules extant in the first portion of the carbon bed lie between the fixed and movable compactor plates.

9. The apparatus of claim 1, wherein a partition wall is located in the interior region to partition the interior region into a first chamber in communication with the first port, a second chamber in communication with the second port, and a turnaround chamber arranged to interconnect and lie in fluid communication with the first and second chambers and wherein a first portion of the carbon bed is located in the first chamber and a second portion of the carbon bed is located in the second chamber.

10. The apparatus of claim 9, wherein the air filter is located in the first chamber and interposed between the first port and the first portion of the carbon bed.

11. The apparatus of claim 10, wherein the canister is formed to include means for retaining the air filter temporarily in the first chamber in an air filter section of the flow path located between the first port and a first portion of the carbon bed so that the air filter can be removed from the air filter section for regeneration or replacement.

12. A fuel vapor recovery apparatus comprising a canister including a housing formed to include an interior region, a first port configured to admit atmospheric air into the interior region, and a second port configured to admit fuel tank fuel vapor into the interior region, a carbon bed located in the interior region to intercept a stream of fuel vapor exiting a fuel tank and flowing into the interior region through the second port along a flow path through the interior region from the second port to the first port and out of the interior region through the first port, and an air filter module comprising an air filter located in the interior region and positioned to lie in the flow path to intercept the stream of fuel vapor exiting the carbon bed and flowing out of the interior region through the first port and to intercept atmospheric air flowing into the interior region through the first port and along the flow path toward the carbon bed and the second port, wherein a partition wall is located in the interior region to partition the interior region into a first chamber in communication with the first port, a second chamber in communication with the second port, and a turnaround chamber arranged to interconnect and lie in fluid communication with the first and second chambers and wherein a first portion of the carbon bed is located in the first chamber and a second portion of the carbon bed is located in the second chamber, wherein the air filter is located in the first chamber and interposed between the first port and the first portion of the carbon bed, and wherein the canister further includes a removable end cap and a retainer, the removable end cap is arranged to mate with the housing to close the first port and formed to include vent aperture means for admitting atmospheric air into the interior region to reach the air filter, and the retainer is coupled to the removable end cap and to the housing to retain the removable end cap temporarily in a mounted position on the housing and the air filter in the interior region of the housing in a position exposed to atmospheric air admitted into the interior region through the vent aperture means formed in the removable end cap until separation of the removable end cap from the housing is needed to gain access to the air filter to allow a user to regenerate or replace the air filter.

13. The apparatus of claim 1, wherein the canister further includes a first end closure coupled to the housing to close the first port and a second end closure coupled to the housing to close the second port, the air filter is located between the first end closure and the carbon bed, and the carbon bed is located between the air filter and the second end closure.

14. The apparatus of claim 13, wherein the air filter module further includes a porous first filter pad mating with the carbon bed and a filter backing plate interposed between the air filter and the porous first filter pad and formed to include an aperture arranged to conduct the stream of fuel vapor flowing along the flow path from the porous first filter pad to the air filter and to conduct the atmospheric air flowing along the flow path from the air filter to the porous first filter pad.

15. The apparatus of claim 14, wherein the air filter module further includes a plate support coupled to the filter backing plate and arranged to extend from the filter backing plate in a direction away from the carbon bed to form a pocket having an outer opening and receiving the air filter therein.

16. The apparatus of claim 15, wherein the plate support is ring-shaped and arranged to surround a perimeter edge of the air filter and lie in an annular space provided between the air filter and the housing.

17. The apparatus of claim 15, wherein the plate support and the filter backing plate cooperate to form a monolithic first filter pad locator made of a plastics material.

18. A fuel vapor recovery apparatus comprising a canister including a housing formed to include an interior region, a first port configured to admit atmospheric air into the interior region, and a second port configured to admit fuel tank fuel vapor into the interior region, a carbon bed located in the interior region to intercept a stream of fuel vapor exiting a fuel tank and flowing into the interior region through the second port along a flow path through the interior region from the second port to the first port and out of the interior region through the first port, and an air filter module comprising an air filter located in the interior region and positioned to lie in the flow path to intercept the stream of fuel vapor exiting the carbon bed and flowing out of the interior region through the first port and to intercept atmospheric air flowing into the interior region through the first port and along the flow path toward the carbon bed and the second port, wherein the canister further includes a first end closure coupled to the housing to close the first port and a second end closure coupled to the housing to close the second port, the air filter is located between the first end closure and the carbon bed, and the carbon bed is located between the air filter and the second end closure, wherein the air filter module further includes a porous first filter pad mating with the carbon bed and a filter backing plate interposed between the air filter and the porous first filter pad and formed to include an aperture arranged to conduct the stream of fuel vapor flowing along the flow path from the porous first filter pad to the air filter and to conduct the atmospheric air flowing along the flow path from the air filter to the porous first filter pad, wherein the air filter module further includes a plate support coupled to the filter backing plate and arranged to extend from the filter backing plate in a direction away from the carbon bed to form a pocket having an outer opening and receiving the air filter therein, and wherein the first end closure includes a first end cap arranged to mate with the housing and formed to include an aperture opening into the interior region of the housing and retainer means for releasably retaining the first end cap in place on the housing to retain the air filter in the pocket and to allow separation of the first end cap from the housing to allow a technician to gain access to the air filter.

19. A fuel vapor recovery apparatus comprising a canister including a housing formed to include an interior region, a first port configured to admit atmospheric air into the interior region, and a second port configured to admit fuel tank fuel vapor into the interior region, a carbon bed located in the interior region to intercept a stream of fuel vapor exiting a fuel tank and flowing into the interior region through the second port along a flow path through the interior region from the second port to the first port and out of the interior region through the first port, and an air filter module comprising an air filter located in the interior region and positioned to lie in the flow path to intercept the stream of fuel vapor exiting the carbon bed and flowing out of the interior region through the first port and to intercept atmospheric air flowing into the interior region through the first port and along the flow path toward the carbon bed and the second port, wherein the canister further includes a first end closure coupled to the housing to close the first port and a second end closure coupled to the housing to close the second port, the air filter is located between the first end closure and the carbon bed, and the carbon bed is located between the air filter and the second end closure, wherein the air filter module further includes a porous first filter pad mating with the carbon bed and a filter backing plate interposed between the air filter and the porous first filter pad and formed to include an aperture arranged to conduct the stream of fuel vapor flowing along the flow path from the porous first filter pad to the air filter and to conduct the atmospheric air flowing along the flow path from the air filter to the porous first filter pad, wherein the air filter module further includes a plate support coupled to the filter backing plate and arranged to extend from the filter backing plate in a direction away from the carbon bed to form a pocket having an outer opening and receiving the air filter therein, and wherein the retainer means is a cam-lock retainer defined by a radially inwardly extending annular lip appended to the plate support and a mating radially outwardly extending rim appended to a flange included in the first end cap in a snap-together relation.

20. A fuel vapor recovery apparatus comprising a canister including a housing formed to include an interior region, a first port configured to admit atmospheric air into the interior region, and a second port configured to admit fuel tank fuel vapor into the interior region, a carbon bed located in the interior region to intercept a stream of fuel vapor exiting a fuel tank and flowing into the interior region through the second port along a flow path through the interior region from the second port to the first port and out of the interior region through the first port, and an air filter module comprising an air filter located in the interior region and positioned to lie in the flow path to intercept the stream of fuel vapor exiting the carbon bed and flowing out of the interior region through the first port and to intercept atmospheric air flowing into the interior region through the first port and along the flow path toward the carbon bed and the second port, wherein the canister further includes a first end closure coupled to the housing to close the first port and a second end closure coupled to the housing to close the second port, the air filter is located between the first end closure and the carbon bed, and the carbon bed is located between the air filter and the second end closure, wherein the air filter module further includes a porous first filter pad mating with the carbon bed and a filter backing plate interposed between the air filter and the porous first filter pad and formed to include an aperture arranged to conduct the stream of fuel vapor flowing along the flow path from the porous first filter pad to the air filter and to conduct the atmospheric air flowing along the flow path from the air filter to the porous first filter pad, wherein the air filter module further includes a plate support coupled to the filter backing plate and arranged to extend from the filter backing plate in a direction away from the carbon bed to form a pocket having an outer opening and receiving the air filter therein, and wherein the retainer means is a cam-lock retainer defined by a radially outwardly extending annular lip appended to the plate support arm and a mating radially inwardly extending rim appended to a flange included in the first end cap in snap-together relation.

21. A fuel vapor recovery apparatus comprising a canister including a housing formed to include an interior region, a first port configured to admit atmospheric air into the interior region, and a second port configured to admit fuel tank fuel vapor into the interior region, a carbon bed located in the interior region to intercept a stream of fuel vapor exiting a fuel tank and flowing into the interior region through the second port along a flow path through the interior region from the second port to the first port and out of the interior region through the first port, and an air filter module comprising an air filter located in the interior region and positioned to lie in the flow path to intercept the stream of fuel vapor exiting the carbon bed and flowing out of the interior region through the first port and to intercept atmospheric air flowing into the interior region through the first port and along the flow path toward the carbon bed and the second port, wherein the canister further includes a first end closure coupled to the housing to close the first port and a second end closure coupled to the housing to close the second port, the air filter is located between the first end closure and the carbon bed, and the carbon bed is located between the air filter and the second end closure and wherein the housing includes a side wall formed to include the interior region and the first port opens into the interior region and the canister further includes a removable first end cap arranged to close the first port and formed to include vent aperture means for admitting atmospheric air into the interior region to reach the air filter and a retainer coupled to the removable first end cap and to the housing to retain the removable first end cap temporarily in a mounted position on the housing and the air filter in the interior region of the housing in a position exposed to atmospheric air admitted into the interior region through the vent aperture means formed in the removable first end cap until separation of the first end cap from the housing is needed to gain access to the air filter to allow a user to regenerate or replace the air filter.

22. The apparatus of claim 21, wherein the retainer is a cam-lock retainer defined by a radially inwardly extending annular lip appended to the plate support and a mating radially outwardly extending rim appended to a flange included in the first end cap in a snap-together relation.

23. The apparatus of claim 21, wherein the retainer means is a cam-lock retainer defined by a radially outwardly extending annular lip appended to the plate support arm and a mating radially inwardly extending rim appended to a flange included in the first end cap in snap-together relation.

* * * * *